US010355355B2

(12) United States Patent
Wu et al.

(10) Patent No.: US 10,355,355 B2
(45) Date of Patent: Jul. 16, 2019

(54) ANTENNA SYSTEM AND CONTROL METHOD

(71) Applicant: PEGATRON CORPORATION, Taipei (TW)

(72) Inventors: Chien-Yi Wu, Taipei (TW); Ya-Jyun Li, Taipei (TW); Chao-Hsu Wu, Taipei (TW); Hung-Ming Yu, Taipei (TW); I-Shu Lee, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 320 days.

(21) Appl. No.: 15/403,193

(22) Filed: Jan. 11, 2017

(65) Prior Publication Data

US 2017/0301989 A1 Oct. 19, 2017

(30) Foreign Application Priority Data

Apr. 15, 2016 (TW) ..... 105111887 A

(51) Int. Cl.

| | |
|---|---|
| ***H01Q 3/34*** | (2006.01) |
| ***H01Q 1/22*** | (2006.01) |
| ***H01Q 3/30*** | (2006.01) |
| ***H01Q 21/06*** | (2006.01) |
| *H01Q 21/24* | (2006.01) |

(52) U.S. Cl.

CPC ..... *H01Q 3/34* (2013.01); *H01Q 1/2291* (2013.01); *H01Q 3/30* (2013.01); *H01Q 21/065* (2013.01); *H01Q 21/245* (2013.01)

(58) Field of Classification Search

CPC ..... H01Q 3/34; H01Q 1/2291; H01Q 3/30; H01Q 21/065

USPC ..... 342/372

See application file for complete search history.

(56) References Cited

U.S. PATENT DOCUMENTS

| | | | | |
|---|---|---|---|---|
| 3,295,134 A * | 12/1966 | Lowe | H01Q 3/40 333/101 |
| 3,737,906 A * | 6/1973 | Maynard | H01Q 3/30 342/371 |
| 5,926,589 A * | 7/1999 | Gaeta | G02B 6/2861 385/15 |
| 6,850,190 B2 | 2/2005 | Rhy et al. | |
| 7,619,997 B2 | 11/2009 | Rofougaran | |
| 7,916,081 B2 | 3/2011 | Lakkis | |

(Continued)

FOREIGN PATENT DOCUMENTS

| | | |
|---|---|---|
| CN | 101904109 A | 12/2010 |
| CN | 103840873 A | 6/2014 |

(Continued)

*Primary Examiner* — Harry K Liu

(74) *Attorney, Agent, or Firm* — McClure, Qualey & Rodack, LLP

(57) ABSTRACT

An antenna system includes an antenna array, a wireless transceiver module and a control module. The antenna array includes a first antenna and a second antenna coupled respectively to the wireless transceiver module. The wireless transceiver module sends and receives signals via the first antenna based on a first phase and sends and receives signals via the second antenna based on a second phase. The control module coupled to the wireless transceiver module, and controls the phase difference between the first phase and the second phase. The radiation pattern of the antenna array is modulated towards one pointing direction based on the phase difference.

9 Claims, 9 Drawing Sheets

(56) References Cited

U.S. PATENT DOCUMENTS

| | | | | |
|---|---|---|---|---|
| 8,264,410 | B1 * | 9/2012 | Wang | H01Q 1/38 343/700 MS |
| 8,532,226 | B2 | 9/2013 | Wambacq | |
| 2011/0032159 | A1 * | 2/2011 | Wu | H01Q 21/08 343/702 |
| 2013/0120203 | A1 * | 5/2013 | Yu | H01Q 13/085 343/770 |
| 2013/0271346 | A1 * | 10/2013 | Dussopt | H01Q 3/46 343/893 |
| 2015/0301275 | A1 * | 10/2015 | Andle | G02B 6/293 385/43 |
| 2016/0126628 | A1 * | 5/2016 | McGeehan | H01Q 3/2682 342/14 |
| 2016/0248169 | A1 * | 8/2016 | Mohammadian | H01Q 21/065 |
| 2017/0012359 | A1 * | 1/2017 | Jung | H01Q 3/30 |
| 2017/0041038 | A1 * | 2/2017 | Kirkpatrick | G01S 13/02 |
| 2017/0149134 | A1 * | 5/2017 | Klemes | H01Q 3/40 |

FOREIGN PATENT DOCUMENTS

| | | | |
|---|---|---|---|
| EP | 1318618 | A2 | 6/2003 |
| EP | 2246934 | A1 | 11/2010 |
| TW | 200503436 | A | 1/2005 |
| TW | I236181 | B | 7/2005 |
| TW | M278082 | | 10/2005 |
| TW | 200832975 | A | 8/2008 |
| TW | 201008028 | A | 2/2010 |
| TW | 201119134 | A | 6/2011 |
| TW | 201534062 | A | 9/2015 |
| TW | I514787 | B | 12/2015 |

* cited by examiner

ANTENNA SYSTEM AND CONTROL METHOD

RELATED APPLICATIONS

This application claims priority to Taiwan Application Serial Number 105111887, filed Apr. 15, 2016, which is herein incorporated by reference.

BACKGROUND

Technical Field

The present disclosure relates to an antenna system. More particularly, the present disclosure relates to a smart antenna, system which can change phase.

Description of Related Art

Modern communication technology is flourishing and has become an indispensable part of modern life. As quality of life improves, faster transmission rates and better signal receiving quality of communication for electronic devices is in demand.

Most traditional wireless area network or bridge antennas using 802.11a/b/g/n protocol have an exposed dipole antenna structure such as multi-input multi-output (MIMO) antenna module having multiple loops, which has Wi-Fi 2.4G antennas and Wi-Fi 5G antennas disposed alternately. One of the common antenna radiation patterns is omnidirectional. When multiple antennas are disposed in array, the radiation patterns of them may interfere with each other.

SUMMARY

The present disclosure discloses an antenna system which can be a bridge device, a wireless broadband router, a wireless hub, a satellite radar, or other antenna systems with higher directivity. The antenna system includes a control module, which can control the phase parameters needed by different antenna radiation patterns and detect the position and strength of transmitted signals of terminal equipment, so as to choose the phase parameter combination having maximal data transmission capacity and optimal quality to transmit data.

An aspect of the present disclosure is an antenna system. The antenna system includes an antenna array, a wireless transceiver module and a control module. The antenna array includes a first antenna and a second antenna coupled respectively to the wireless transceiver module. The wireless transceiver module sends and receives signals via the first antenna based on a first phase and sends and receives signals via the second antenna based on a second phase. The control module is coupled to the wireless transceiver module, and controls the phase difference between the first phase and the second phase. The radiation pattern of the antenna array deviates towards one pointing direction based on the phase difference.

Another aspect of the present disclosure is a control method. The control method is used for an antenna system, wherein the antenna system comprises an antenna array. The antenna array comprises a first antenna and a second antenna. The control method comprises: sending and receiving signals via the first antenna based on a first phase; sending and receiving signals via the second antenna based on a second phase; and controlling a phase difference between the first phase and the second phase, wherein a radiation pattern of the antenna array deviates towards one pointing direction based on the phase difference.

According to the technology disclosed here, the antenna system can have the function of selectively adjusting the pointing direction of antenna radiation pattern and have more accurate locating mechanism, so an optimal data transmission rate can be achieved. Accordingly, a user can have an improved user experience.

DETAILED DESCRIPTION

Specific embodiments of the present invention are further described in detail below with reference to the accompanying drawings, however, the embodiments described are not intended to limit the present invention and it is not intended for the description of operation to limit the order of implementation. Moreover, any device with equivalent functions that is produced from a structure formed by a recombination of elements shall fall within the scope of the present invention. Additionally, the drawings are only illustrative and are not drawn to actual size. In accordance with the standard practice in the industry, various features are not drawn to scale. In fact, the dimensions of the various features may be arbitrarily increased or reduced for clarity of discussion.

Figure 1:
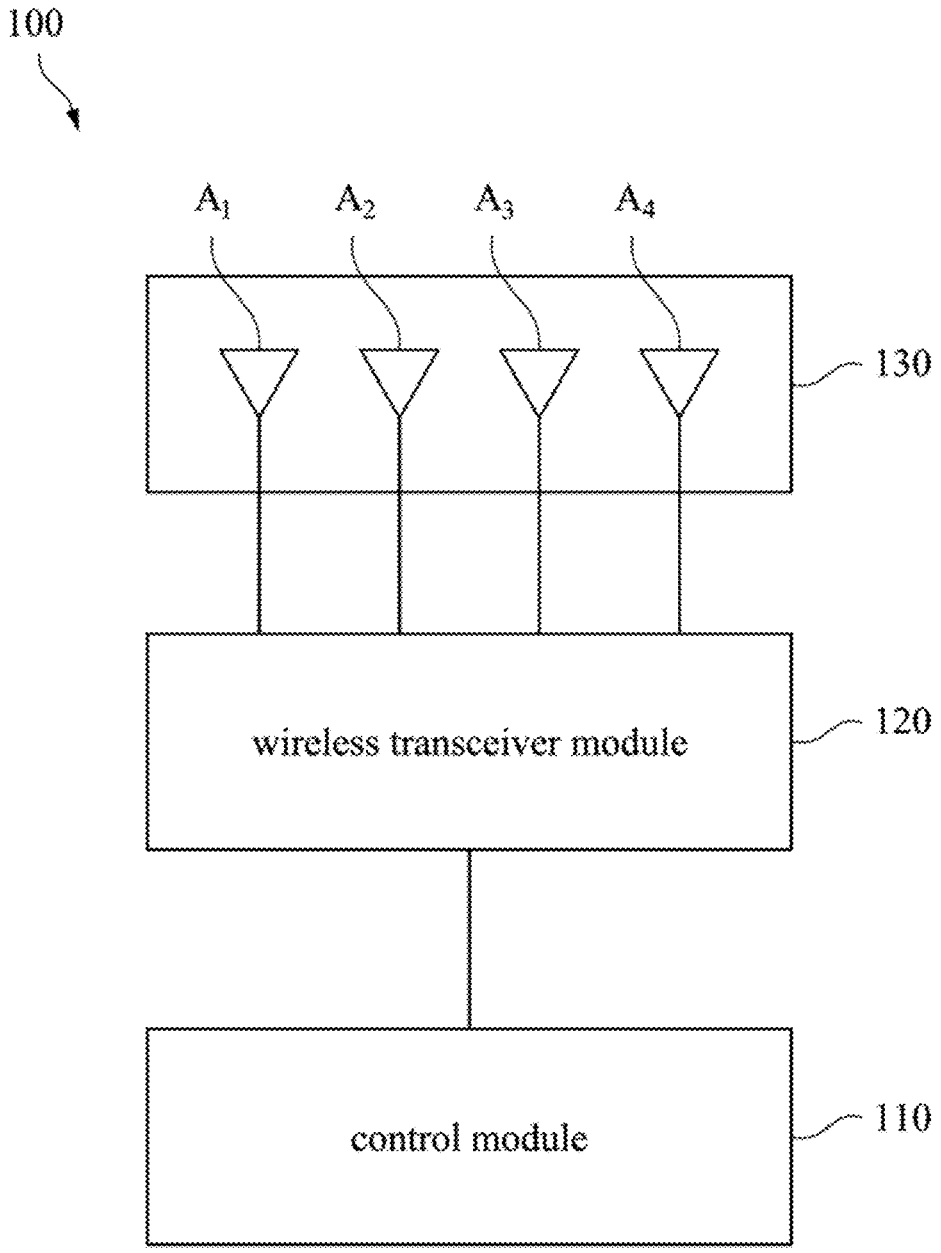
FIG. 1 is a block diagram of an antenna system according to an embodiment of this disclosure.

Reference is made first to FIG. 1. FIG. 1 depicts a block diagram of an antenna system 100 according to an embodiment of this disclosure. As shown in FIG. 1, the antenna system 100 includes a control module 110, a wireless transceiver module 120 and an antenna array 130. In the embodiment of FIG. 1, the antenna array 130 includes antennas $A_1$, $A_2$, $A_3$ and $A_4$. The wireless transceiver module 120 is coupled to the control module 110. The control module 110 is used to control the wireless transceiver module 120 and receive and send signals via the antenna array 130.

The control module 110 can control the wireless transceiver module 120 to generate transmitting signals with different phases, or control the wireless transceiver module 120 to receive signals with different phases, so as to achieve desired phase difference. The control module 110 can be, for example, a central processing unit (CPU) or a system on chop (SoC), and achieve the mechanism to control the phase difference by a program algorithm or a software writing program.

Figure 2:
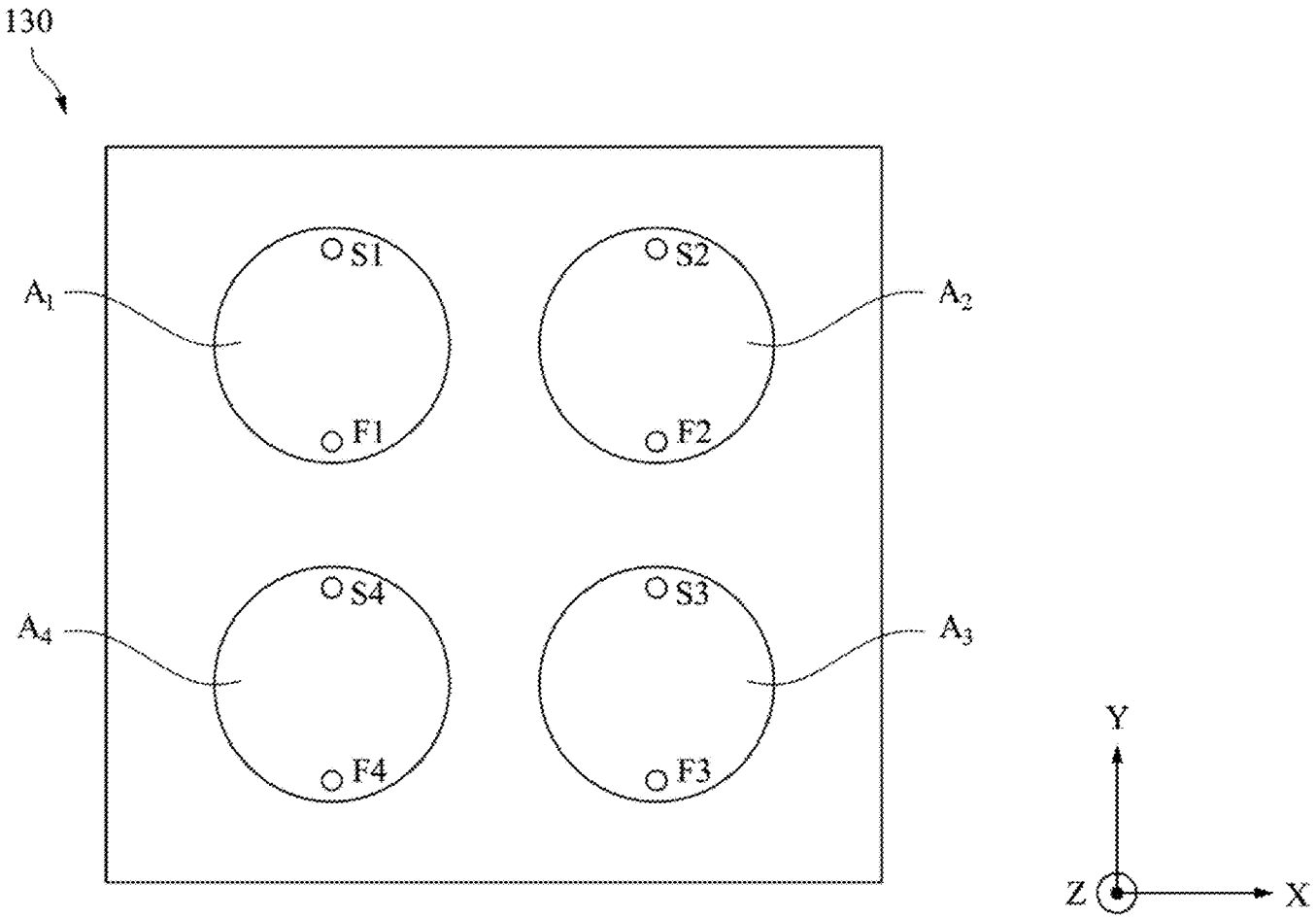
FIG. 2 is a top view of an inner structure of the antenna array of FIG. 1 according to an embodiment of this disclosure.

Reference is made to FIG. 2. FIG. 2 depicts a top view of an inner structure of the antenna array 130 of FIG. 1 according to an embodiment of this disclosure. Follow the aforementioned embodiment, for example, the antenna $A_1$, $A_2$, $A_3$ and $A_4$ surround a center in a clockwise direction. It should be noted that the configuration location of each antenna is just an embodiment for convenience, and the spirit of the present disclosure is not limited thereto. The antenna $A_1$, $A_2$, $A_3$ and $A_4$ respectively include ground terminals S1, S2, S3 and S4, and are respectively coupled to signal feed-in points F1, F2, F3 and F4 of the wireless transceiver module. In this embodiment, each of the antennas $A_1$, $A_2$, $A_3$ and $A_4$ is a patch antenna.

Two of the antenna $A_1$, $A_2$, $A_3$ and $A_4$ of the antenna array 130 receive and send signals based on a first phase, and another two of the antenna $A_1$, $A_2$, $A_3$ and $A_4$ receive and send signals based on a second phase. For example, set the center of the antennas $A_1$, $A_2$, $A_3$ and $A_4$ as the origin of coordinate, and the antennas $A_1$ and $A_2$ receive and send signals based on the first phase while the antennas $A_3$ and $A_4$ receive and send signals based on the second phase. When the first phase is leading the second phase, a radiation pattern of the antenna array 130 deviates towards the antennas $A_1$ and $A_2$. That is, the radiation pattern of the antenna array 130 deviates towards the Y-axis direction (reference is also made to FIG. 4 radiation patterns U1-U4 deviate towards the Y-axis direction). On the contrary, when the second phase is leading the first phase, the radiation pattern of the antenna array 130 deviates towards the antennas $A_3$ and $A_4$, i.e., the negative Y-axis direction.

In another embodiment, the antennas $A_2$ and $A_3$ can receive and send signals based on the first phase and the antennas $A_1$ and $A_4$ can receive and send signals based on the second phase. In this embodiment, when the first phase is leading the second phase, the radiation pattern of the antenna array 130 deviates towards the antennas $A_2$ and $A_3$. That is, the radiation pattern of the antenna array 130 deviates towards the X-axis direction (reference is also made to FIG. 5, radiation patterns R1-R4 deviate towards the X-axis direction). On the contrary, when the second phase is leading the first phase, the radiation pattern of the antenna array 130 deviates towards the antennas $A_1$ and $A_4$, i.e., the negative X-axis direction.

Figure 3:
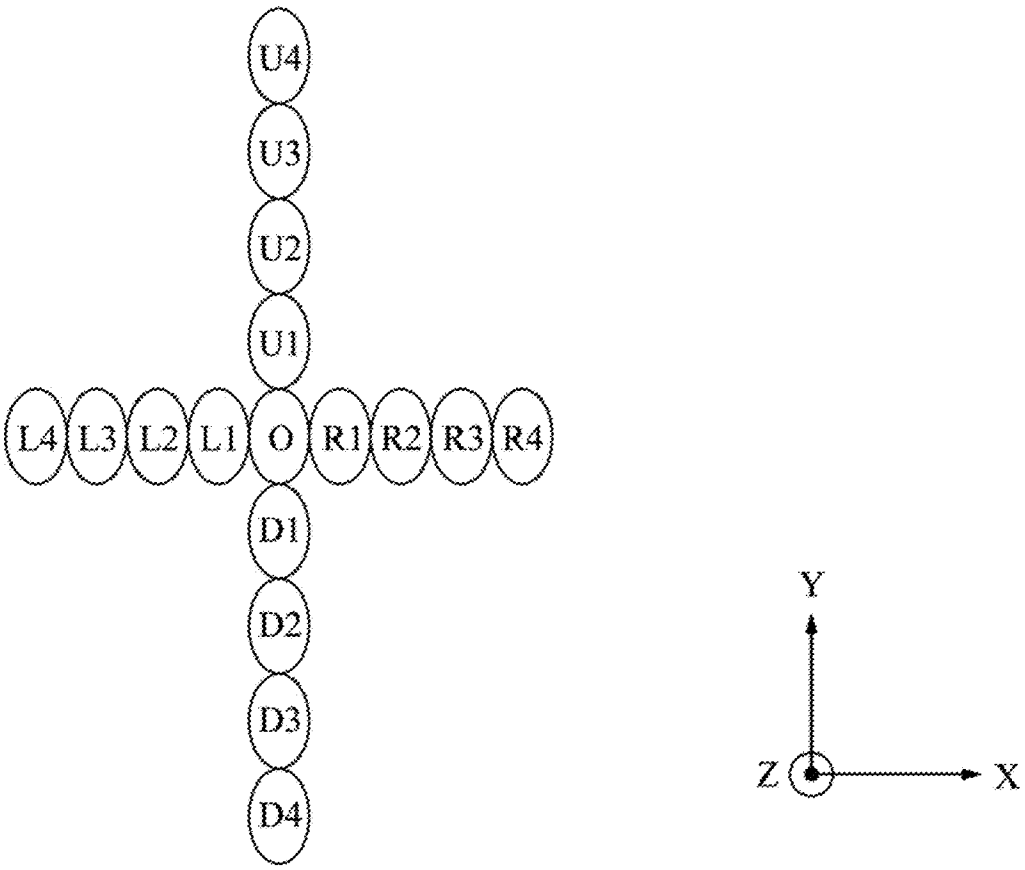
FIG. 3 is a schematic diagram of radiation patterns with different phases and corresponding pointing directions of the antennas of the antenna array depicted in FIG. 2 according to an embodiment of this disclosure.
Figure 4:
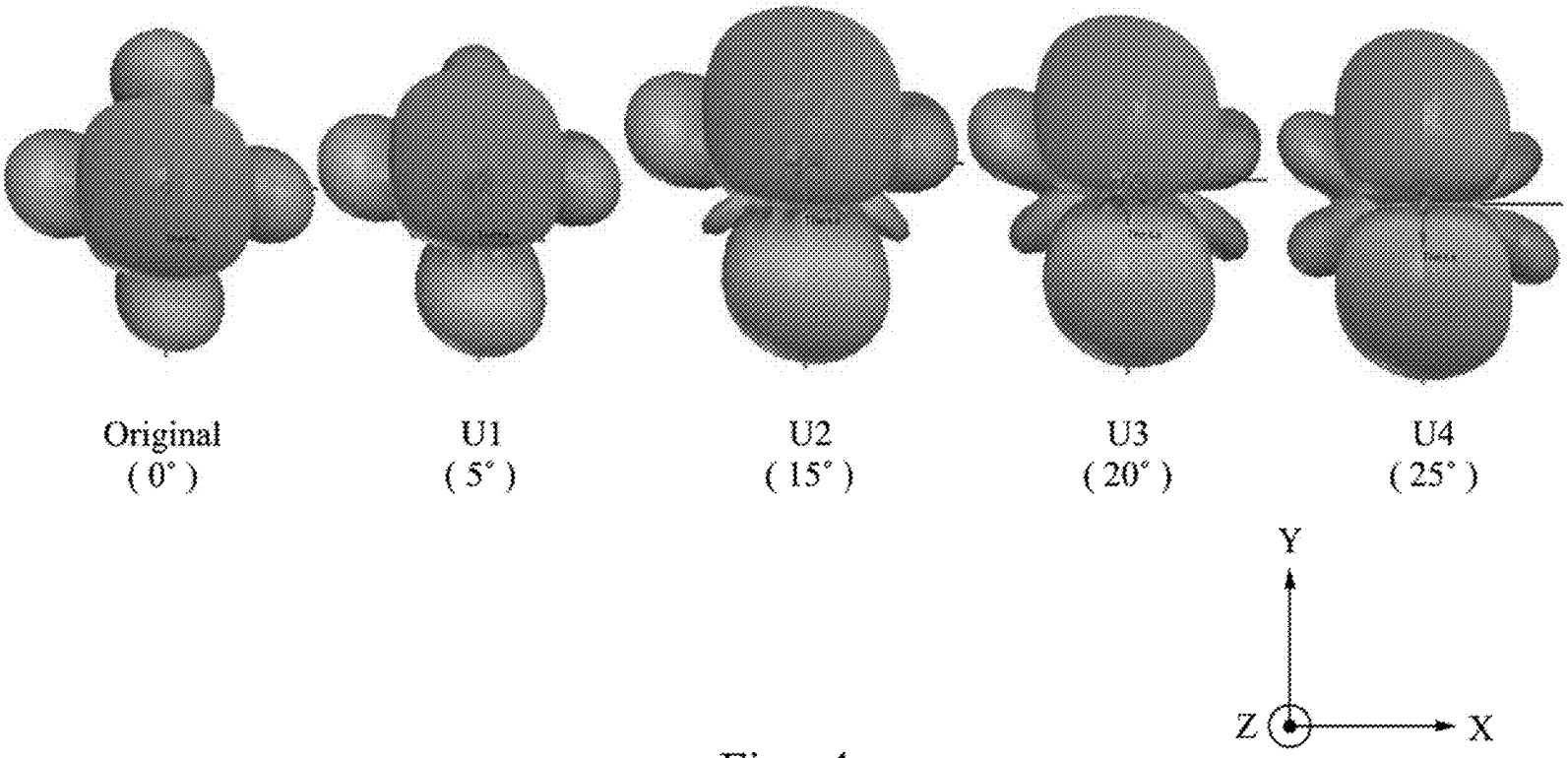
FIG. 4 is a schematic diagram of 3D fields of some radiation patterns according to an embodiment of this disclosure.
Figure 5:
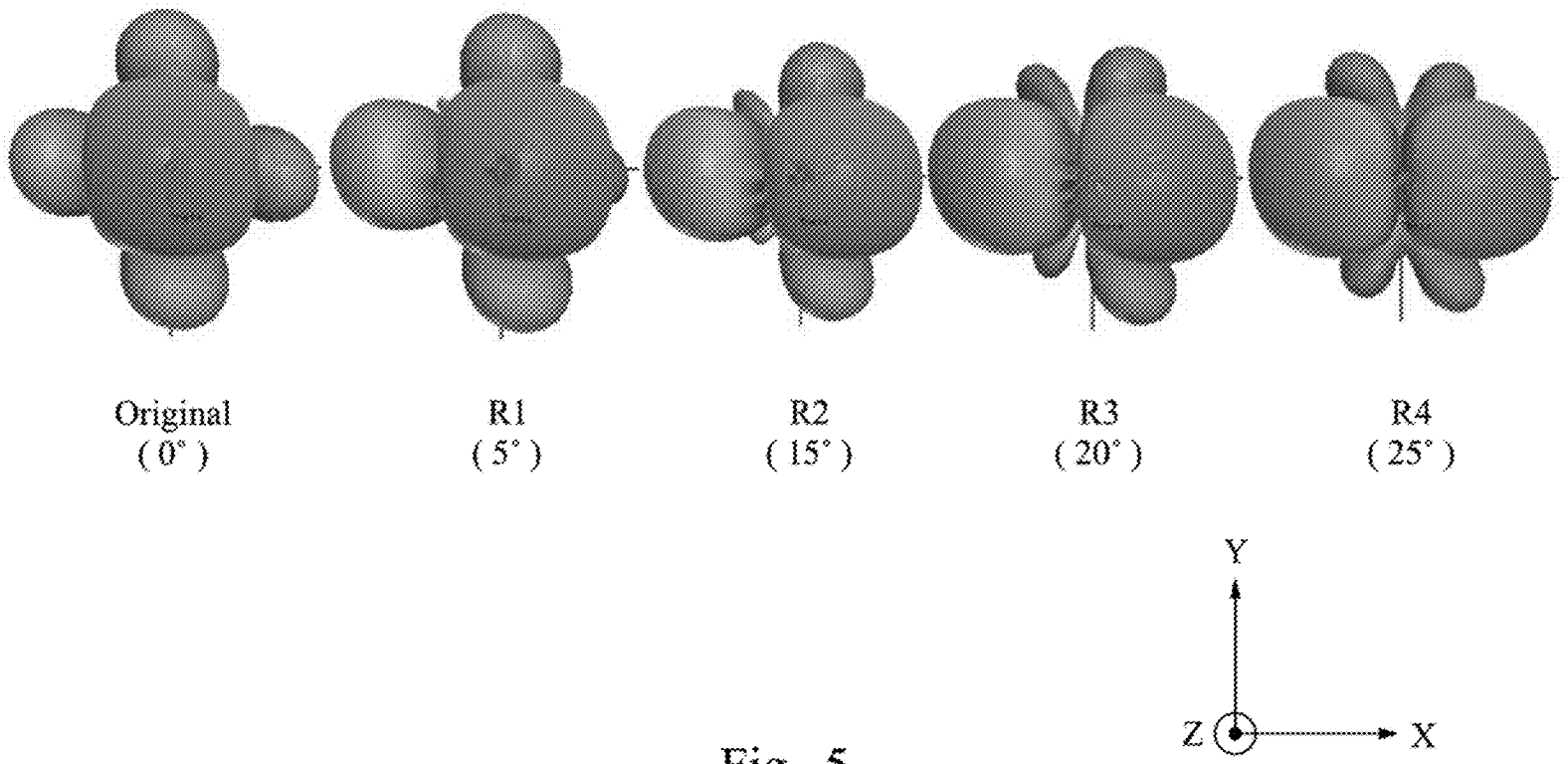
FIG. 5 is a schematic diagram of 3D fields of some radiation patterns according to an embodiment of this disclosure.

Referring to FIGS. 3, 4 and 5. FIG. 3 depicts a schematic diagram of the radiation patterns and the corresponding pointing directions formed by the antennas $A_1$, $A_2$, $A_3$ and $A_4$ of the antenna array 130 of FIG. 2 when using different phase. FIG. 4 depicts a schematic diagram of 3D fields of the radiation patterns U1-U4. FIG. 5 depicts a schematic diagram of 3D fields of the radiation patterns R1-R4. According to different feed-in phases and different phase differences, the radiation patterns of the antenna array 130 have the characteristic of rotation, which further forming different directivity.

For example, the relation between the signal feeding phases of the antennas $A_1$, $A_2$, $A_3$ and $A_4$ and the pointing direction variation of the antenna array radiation patterns is illustrated in table 1 below:

TABLE 1

| | pattern | | | | | | | | |
|---|---|---|---|---|---|---|---|---|---|
| phase(°) | Original | L1 | L2 | L3 | L4 | R1 | R2 | R3 | R4 |
| $\phi_1$ | 0 | 45 | 90 | 135 | 180 | 0 | 0 | 0 | 0 |
| $\phi_2$ | 0 | 0 | 0 | 0 | 0 | 45 | 90 | 135 | 180 |
| $\phi_3$ | 0 | 0 | 0 | 0 | 0 | 45 | 90 | 135 | 180 |
| $\phi_4$ | 0 | 45 | 90 | 135 | 180 | 0 | 0 | 0 | 0 |
| | pattern | | | | | | | | |
| phase(°) | Original | U1 | U2 | U3 | U4 | D1 | D2 | D3 | D4 |
| $\phi_1$ | 0 | 45 | 90 | 135 | 180 | 0 | 0 | 0 | 0 |
| $\phi_2$ | 0 | 45 | 90 | 135 | 180 | 0 | 0 | 0 | 0 |
| $\phi_3$ | 0 | 0 | 0 | 0 | 0 | 45 | 90 | 135 | 180 |
| $\phi_4$ | 0 | 0 | 0 | 0 | 0 | 45 | 90 | 135 | 180 |

The φ1, φ2, φ3, φ4 listed in left column of table 1 represent the feeding phases of the antennas $A_1$, $A_2$, $A_3$ and $A_4$ of FIG. 1 and FIG. 2, respectively. The center point O (Original) of FIG. 3 is the non-deviated radiation pattern pointing direction when the phase of the signal transmitted by each antenna is 0 degree, i.e., when there is no phase difference between the four feeding phases, which is perpendicular to the plane of the antennas $A_1$, $A_2$, $A_3$ and $A_4$. When the phase difference isn't zero, the radiation patterns and the pointing directions are as the radiation patterns U1-U4, D1-D4, R1-R4 and L1-L4 shown in FIG. 4 and table 1.

Take the radiation patterns R1-R4 in table 1 as an example, in the radiation pattern R1 both the phases φ2 and φ3 are leading the phases φ1 and φ4 by 45 degrees. In the radiation pattern R2, both the phases φ2 and φ3 are leading the phases φ1 and φ4 by 90 degrees. In the radiation pattern R3, both the phases φ2 and φ3 are leading the phases φ1 and φ4 by 135 degrees. In the radiation pattern R4, both the phases φ2 and φ3 are leading the phases φ1 and φ4 by 180 degrees.

When the angle the phases φ2 and φ3 leading the phases φ1 and φ4 gradually becomes larger, the radiation pattern of the antenna array 130 gradually converts into the radiation pattern R4 from the radiation pattern R1, and the pointing direction gradually deviates towards X-axis direction from the original point O (as shown in FIG. 5).

Take the radiation patterns U1-U4 of table 1 a an example, in the radiation pattern U1, both the phases φ1 and φ2 are leading the phases φ3 and φ4 by 45 degrees. In the radiation pattern U2 both the phases φ1 and φ2 are leading the phases φ3 and φ4 by 90 degrees. In the radiation pattern U3 both the phases φ1 and φ2 are leading the phases φ3 and φ4 by 135 degrees. In the radiation pattern U4, both the phases φ1 and φ2 are leading the phases φ3 and φ4 by 180 degrees.

When the angle the phases φ1 and φ2 leading the phases φ3 and φ4 gradually becomes larger, the radiation pattern of the antenna array 130 gradually converts into the radiation pattern U4 from the radiation pattern U1, and the pointing direction gradually deviates towards Y-axis direction from the original point O (as shown in FIG. 4).

Because the radiation patterns D1-D4 and the radiation patterns L1-L4 are respectively symmetrical with the radiation patterns U1-U4 and the radiation patterns R1-R4 relative to original point O, the three-dimensional simulation of the radiation patterns D1-D4 and the radiation patterns L1-L4 will not be show in figures.

In one embodiment, the antenna $A_1$ and the antenna $A_2$ receive and, send signals based on the first phase while the antenna $A_3$ and the antenna $A_4$ receive and send signals based on the second phase, as the radiation patterns U1-U4 and D1-D4 shorn in FIG. 3 and table 1. In another embodiment, the antenna $A_1$ and the antenna $A_4$ receive and send signals based on the first phase while the antenna $A_2$ and the antenna $A_3$ receive and send signals based on the second phase, as the radiation patterns R1-R4 and L1-L4 shown in FIG. 3 and table 1.

For further explanation, the characteristic of angle rotation of the pointing directions and peek gains of the radiation patterns generated by the antenna array 130 according to different feeding phases and different phase differences are shown in table 2 below:

TABLE 2

| | pattern | | | | | | | | |
|---|---|---|---|---|---|---|---|---|---|
| gain | Original | U1 | U2 | U3 | U4 | D1 | D2 | D3 | D4 |
| Angle rotation (°) | 0 | 5 | 15 | 20 | 25 | 5 | 15 | 20 | 25 |
| 3D Peak Gain (dB) | 15.19 | 14.95 | 14.47 | 13.65 | 12.36 | 15.1 | 14.69 | 13.81 | 12.36 |
| | pattern | | | | | | | | |
| gain | Original | R1 | R2 | R3 | R4 | L1 | L2 | L3 | L4 |
| Angle rotation (°) | 0 | 5 | 10 | 20 | 25 | 10 | 15 | 20 | 25 |
| 3D Peak Gain (dB) | 15.19 | 14.95 | 14.39 | 13.73 | 12.6 | 15.11 | 14.67 | 13.74 | 12.6 |

It should be appreciated that when the phase difference between two feeding phases is larger, the deviated angle of the radiation pattern is larger, i.e., more deviated from the perpendicular direction (no phase difference) of the original point O.

For example, when the antennas $A_1$ and $A_2$ are fed signals with the first phase of 90 degrees and the antennas $A_3$ and $A_4$ are fed signals with the second phase of 0 degree ("U2" column of table 1), because the first phase is leading the second phase by 90 degrees, the radiation patterns will deviate towards the direction of the antennas $A_1$ and $A_2$ (i.e., the Y-axis direction), as the 3D simulation of U2 shown in FIG. 4 and the direction of U2 shown in FIG. 3. Wherein the pointing direction of U2 deviates from the perpendicular direction of the original point O by 15 degrees (table 2). In another embodiment, when the antennas $A_1$ and $A_4$ are fed signals with the first phase of 0 degree and the antennas $A_2$ and $A_3$ are fed signals with the second phase of 180 degrees ("R4" column of table 1), because the second phase is leading the first phase by 180 degrees, the radiation pattern will deviate towards the direction of the antenna $A_2$; $A_3$ (i.e., the X-axis direction), as the 3D simulation of R4 shown in FIG. 5 and the direction of R4 shown in FIG. 3. Wherein the pointing direction of R4 deviates from the perpendicular direction of the original point O by 25 degrees (table 2).

Figure 6:
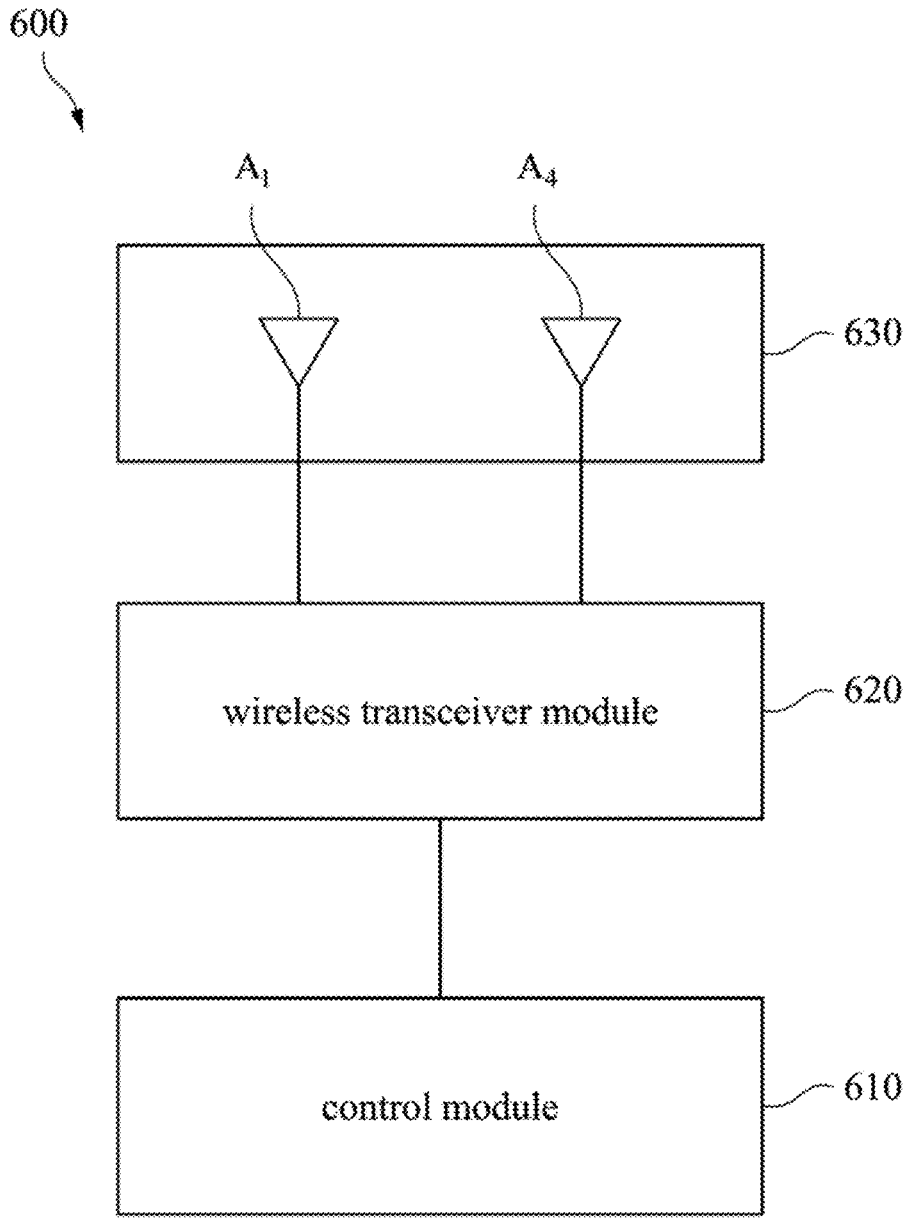
FIG. 6 is a configuration diagram of an antenna system according to an embodiment of this disclosure.

The aforementioned FIGS. 1-5 illustrate the embodiment of the antenna array 130 including the four antennas $A_1$, $A_2$, $A_3$ and $A_4$, but the present disclosure is not limited in this regard. In another embodiment, reference is also made to FIG. 6. FIG. 6 depicts a configuration diagram of another antenna system 600 according to an embodiment of this disclosure. In the embodiment of FIG. 6, the antenna system 600 includes a control module 610, a wireless transceiver module 620 and an antenna array 630. The antenna array 630 includes two antennas (e.g., the antennas $A_1$ and $A_4$ of the antenna system 100), wherein one of the antennas receives and sends signals based on a first phase while another one receives and sends signals based on a second phase. The control module 610 is used to control the first phase and the second phase to make the first phase and the second phase the same or generate a phase difference between the first phase and the second phase. When the first phase is leading the second phase, the radiation pattern of the antennas deviates towards the one of the antennas (like the pointing direction of the radiation patterns U1-U4 depicted in FIG. 3). On the contrary, when the second phase is leading the first phase, the radiation pattern of the antennas deviates towards the another one of the antennas (like the pointing direction of the radiation patterns D1-D4 depicted in FIG. 3). When the first phase is substantially the same as the second phase, the radiation pattern of the antenna array 630 substantially locates at a central line of the antenna $A_1$ and the antenna $A_4$. That is, the number of the antennas of the antenna array 630 is not limited to four. The number of antennas can be changed according to practical application, so as to make the pointing direction of the antenna radiation pattern has a variety of types.

Figure 7:
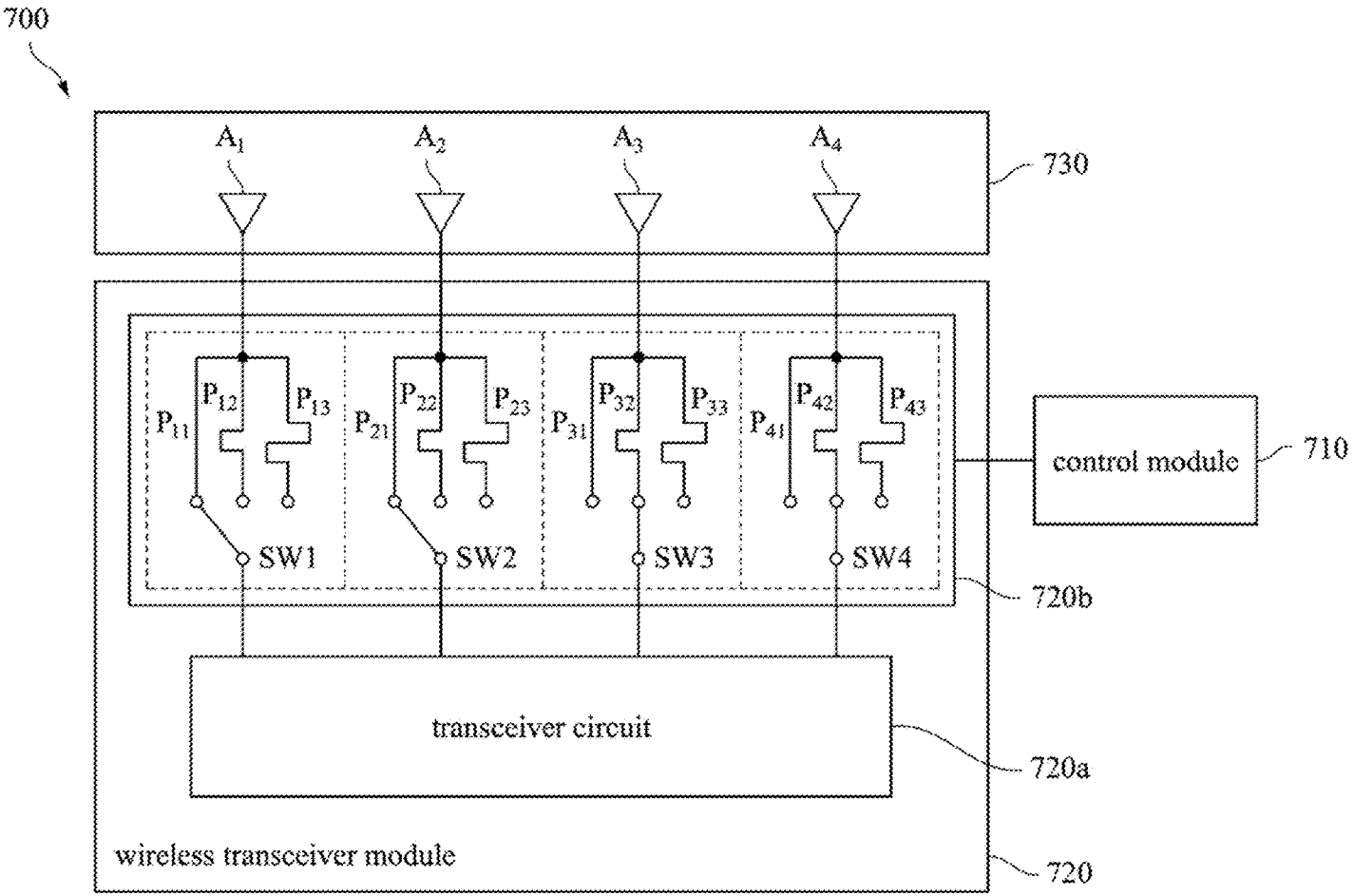
FIG. 7 is a configuration diagram of an antenna system according to an embodiment of this disclosure.

In one embodiment of the present disclosure, the phase difference between feeding phases of antennas can be controlled by, for example, changing the path length of the physical circuit. Reference is made to FIG. 7, an antenna system 700 includes a control module 710, a wireless transceiver module 720, and an antenna array 730 including antennas $A_1$, $A_2$, $A_3$ and $A_4$. The connection relationship of the control module 710, the wireless transceiver module 720 and the antenna array 730 is the same as the modules of the same name in the aforementioned embodiment so the connection relationship will not be repeated again.

In this embodiment, the wireless transceiver module 720 includes a transceiver circuit 720*a* and a phase switching circuit 720*b*. The phase switching circuit 720*b* includes switching units SW1-SW4. The switching units SW1, SW2, SW3 and SW4 are respectively coupled to antennas $A_1$, $A_2$, $A_3$ and $A_4$. The switching unit SW1 includes electric current paths $P_{11}$, $P_{12}$ and $P_{13}$. The switching unit SW2 includes electric current paths $P_{21}$, $P_{22}$ and $P_{23}$. The switching unit SW3 includes electric current paths $P_{31}$, $P_{32}$ and $P_{33}$. The switching unit SW4 includes electric current paths $P_{41}$, $P_{42}$ and $P_{43}$. The lengths of the electric current paths $P_{11}$, $P_{21}$, $P_{31}$ and $P_{41}$ are equal. The lengths of the electric current path $P_{12}$, $P_{22}$, $P_{32}$ and $P_{42}$ are one quarter-wavelength longer than the lengths of the electric current path $P_{11}$, $P_{21}$, $P_{31}$ and $P_{41}$. The lengths of the electric current path $P_{13}$, $P_{23}$, $P_{33}$ and $P_{43}$ are one quarter-wavelength longer than the lengths of the electric current paths $P_{12}$, $P_{22}$, $P_{32}$ and $P_{42}$.

The control module 710 directly or indirectly controls the path switching of each switching unit within the phase switching circuit 720*b*. Specifically, each quarter-wavelength path provides a phase difference change of 90 degrees. For example, when the switching units SW1 and SW2 respectively switch to the paths and $P_{11}$ and $P_{21}$, the signal feeding phase is 0 degree. When the switching units SW3 and SW4 respectively switch to the paths $P_{32}$ and $P_{42}$ which have one quarter-wavelength longer than the paths $P_{11}$ and $P_{21}$, the signal feeding phase is 90 degrees. Accordingly, the antennas $A_3$ and $A_4$ are leading the antennas $A_1$ and $A_2$ by a phase difference of 90 degrees, so the pointing direction of the radiation pattern will deviate towards the antennas $A_3$ and $A_4$. In summary, with the phase switching circuit 720*b*, the transceiver circuit 720*a* can send or receive signals of radiation patterns of different pointing directions.

It should be noted that, the aforementioned embodiment is just one aspect of the present disclosure, and the switching units can also have more than three electric current paths of different lengths, wherein the path length depends on demands to achieve the antenna radiation pattern pointing direction needed.

Figure 8:
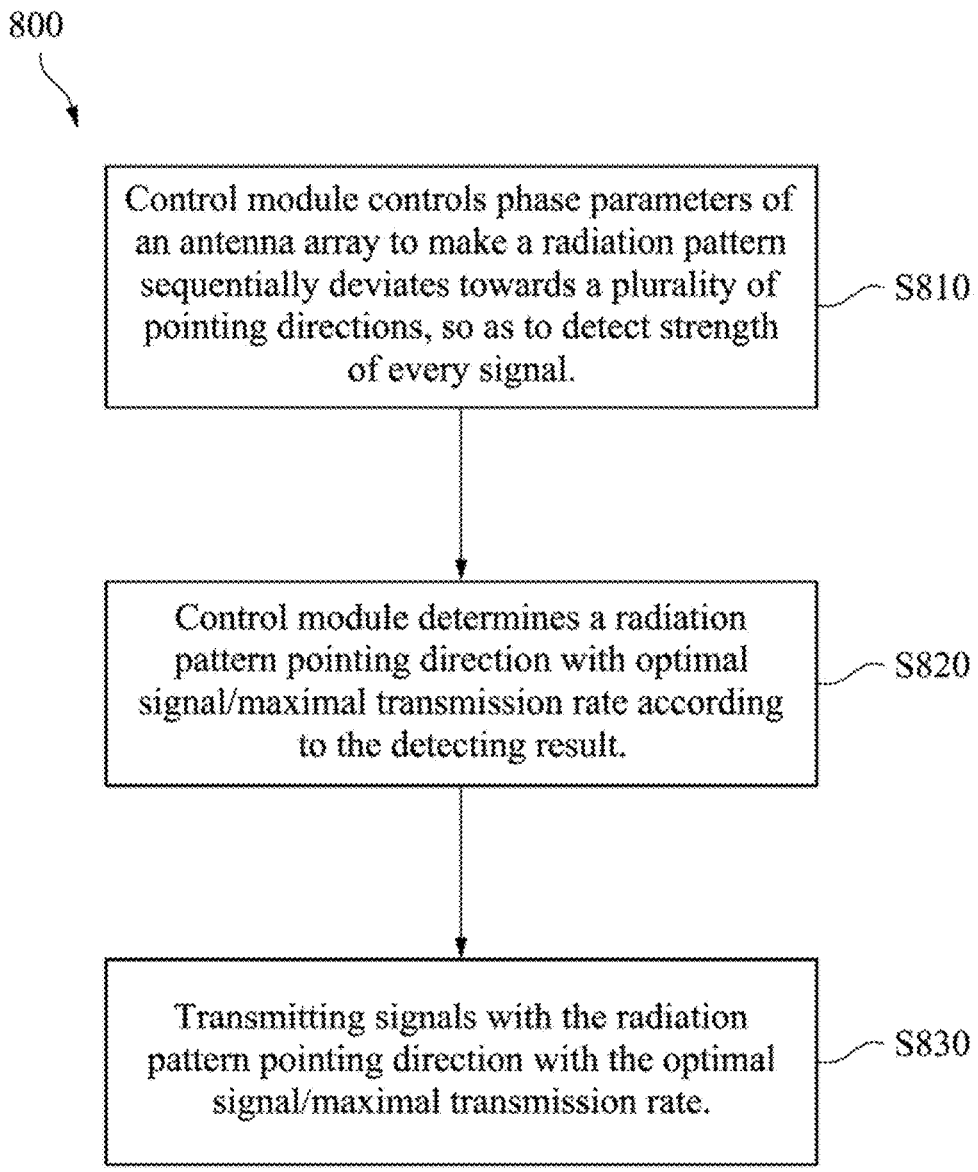
FIG. 8 is a control method flow chart of an antenna system according to an embodiment of this disclosure.
Figure 9:
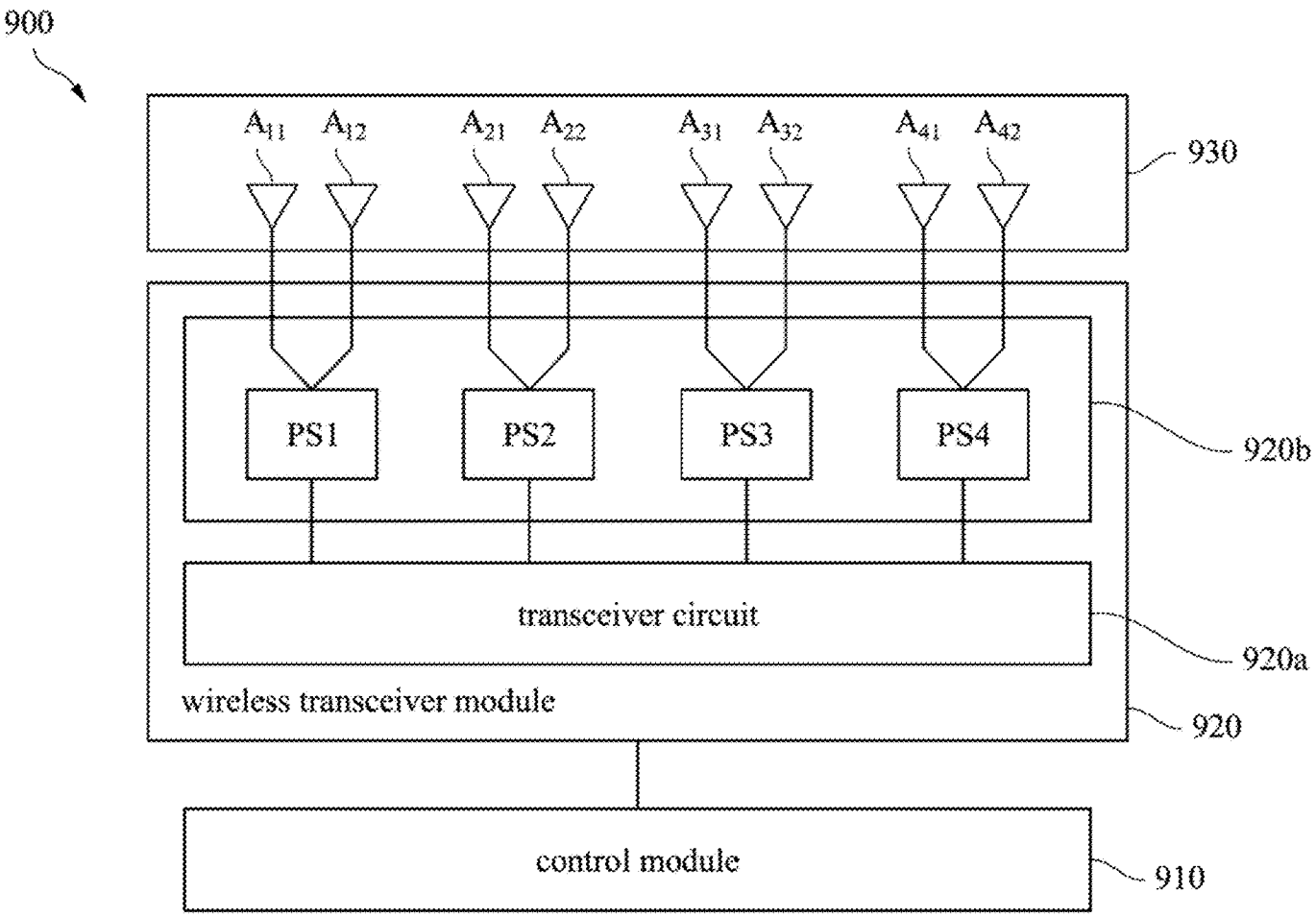
FIG. 9 is a configuration diagram of an antenna system according to an embodiment of this disclosure.

FIG. 8 depicts a control method flow chart of an antenna system 800 according to an embodiment of this disclosure. In the control method 800, step S810 is a scanning and detecting step. In step S810, a control module can control phase parameters of an antenna array to make a radiation pattern sequentially deviates towards a plurality of pointing directions, so as to further detect strength of every signal received with every radiation pattern pointing direction. In step S820, the control module can determine and choose a radiation pattern pointing direction with optimal signal or maximal transmission rate according to the detecting result of step S810. In step S830, an antenna system transmits signals with the radiation pattern pointing direction chosen by the abovementioned steps. In addition, the control method 800 can be continued repeating. For example, repeating steps S810 to S830 after every time period, so as, to ensure that the antenna system can transmit signals with the optimal transmission quality at any time point.

In another embodiment of the present disclosure, an antenna system 900 can includes a control module 910, a wireless transceiver module 920 and an antenna array 930 including antennas $A_{11}$, $A_{12}$, $A_{21}$, $A_{22}$, $A_{31}$, $A_{32}$, $A_{41}$ and $A_{42}$. The wireless transceiver module 920 includes a transceiver circuit 920*a* and a polarization switch 920*b*. The polarization switch 920*b* comprises polarization switching circuits PS1, PS2, PS3 and PS4, wherein PS1 is coupled to the antennas $A_{11}$ and $A_{12}$, PS2 is coupled to the antennas $A_{21}$ and $A_{22}$, PS3 is coupled to the antennas $A_{31}$ and $A_{32}$, and PS4 is coupled to the antennas and $A_{42}$. The antennas $A_{11}$ and $A_{12}$ are a group of antennas having different polarization directions (e.g., perpendicular to each other), so the antennas $A_{11}$ and $A_{12}$ can transmit signals of different polarization directions. The antennas $A_{21}$ and $A_{22}$ form a group, $A_{31}$ and $A_{32}$ form a group, and $A_{41}$ and $A_{42}$ form a group wherein the configuration of each group is the same as that of the group of antennas $A_{11}$ and $A_{12}$. The polarization switch 920*b* can switch each group of antennas to select a polarization direction with better signal quality to transmit signals.

In summary, the present disclosure provides an antenna system which can adjust its radiation pattern. By adjusting the radiation pattern, the antenna system can adjust antenna beam direction intelligently. Especially, the antenna system can use phase control technology to adjust antenna radiation pattern according to a location of a target terminal device, so as to provide optimal transmission rate for the target terminal device. In one embodiment, an antenna system can have a control module to achieve the aforementioned phase control technology.

What is claimed is:

1. An antenna system, comprising:

an antenna array, comprising a first antenna and a second antenna;

a wireless transceiver module, respectively coupled to the first antenna and the second antenna, the wireless transceiver module sends and receives signals via the first antenna based on a first phase and sends and receives signals via the second antenna based on a second phase; and a control module, coupled to the wireless transceiver module and configured to control a phase difference between the first phase and the second phase, wherein a radiation pattern of the antenna array deviates towards one pointing direction based on the phase difference, wherein the antenna array further comprises a third antenna and a forth antenna, the first antenna, the second antenna, the third antenna and the forth antenna are disposed around a center, the wireless transceiver module sends and receives signals via the forth antenna based on the first phase and sends and receives signals via the third antenna based on the second phase.

2. The antenna system of claim 1, wherein when the first phase is leading the second phase, the radiation pattern of the antenna array deviates towards the first antenna.

3. The antenna system of claim 1, wherein when the second phase is leading the first phase, the radiation pattern of the antenna array deviates towards the second antenna.

4. The antenna system of claim 3, wherein when the first phase is leading the second phase, the radiation pattern of the antenna array deviates towards the first antenna and the forth antenna from the center.

5. The antenna system of claim 3, wherein when the second phase is leading the first phase, the radiation pattern of the antenna array deviates towards the second antenna and the third antenna from the center.

6. A control method, used for an antenna system, wherein the antenna system comprises an antenna array, the antenna array comprises a first antenna and a second antenna, the control method comprises:

sending and receiving signals via the first antenna based on a first phase;

sending and receiving signals via the second antenna based on a second phase; and controlling a phase difference between the first phase and the second phase, wherein a radiation pattern of the antenna array deviates towards one pointing direction based on the phase difference, wherein the antenna array further comprises a third antenna and a forth antenna, the first antenna, the second antenna, the third antenna and the forth antenna are disposed around a center, the control method further comprising:

sending and receiving signals via the forth antenna based on the first phase; and sending and receiving signals via the third antenna based on the second phase.

7. The control method of claim 6, further comprising:

controlling the phase difference between the first phase and the second phase to make the radiation pattern of the antenna array sequentially deviates towards a plurality of different pointing directions based on the phase difference; and detecting a plurality of signal strengths of the radiation pattern of the antenna array corresponding to the different pointing directions.

8. The control method of claim 7, further comprising:

choosing a pointing direction corresponding to the strongest signal strength from the different pointing directions as a selected pointing direction, and sending or receiving signals with the selected pointing direction.

9. The control method of claim 6, wherein when the first phase is leading the second phase, the radiation pattern of the antenna array deviates towards the first antenna.

* * * * *